United States Patent [19]

Kreinberg et al.

[11] Patent Number: 4,869,673

[45] Date of Patent: Sep. 26, 1989

[54] CIRCUIT PANEL ASSEMBLY WITH ELEVATED POWER BUSES

[75] Inventors: Earl R. Kreinberg, Phoenix; Roger N. Polk, Glendale, both of Ariz.

[73] Assignee: AMP Incorporated, Harrisburg, Pa.

[21] Appl. No.: 306,221

[22] Filed: Feb. 3, 1989

Related U.S. Application Data

[63] Continuation of Ser. No. 127,746, Dec. 2, 1987, abandoned.

[51] Int. Cl.[4] ..... H01R 23/68

[52] U.S. Cl. ..... 439/64; 361/407; 439/55

[58] Field of Search ..... 439/55, 59–64, 439/79, 80; 361/407, 413

[56] References Cited

U.S. PATENT DOCUMENTS

| | | | |
|---|---|---|---|
| 3,155,767 | 11/1964 | Schellack | 174/68.5 |
| 3,466,382 | 9/1969 | Rocklitz | 174/72 |
| 3,491,267 | 1/1970 | Goshorn | 439/55 |
| 3,708,610 | 1/1973 | Kozel et al. | 174/72 |
| 4,236,046 | 11/1980 | De Vries | 174/72 |
| 4,394,532 | 7/1983 | Aguayo | 174/72 |
| 4,405,189 | 9/1983 | Douty et al. | 339/17 |
| 4,585,285 | 4/1986 | Martens | 361/407 |
| 4,603,927 | 8/1986 | Gardner | 361/407 |

FOREIGN PATENT DOCUMENTS

| | | | |
|---|---|---|---|
| 860358 | 2/1961 | United Kingdom | 361/413 |

OTHER PUBLICATIONS

IBM Bulletin, Steenburgh, vol. 19, No. 3, p. 792, 8–1976.

Electri-onics, "Bus Bars for PCB Applications Keyed to Design, Performance", Jun. 1984, pp. 23–26.

The Western Electrical Engineer, "Printed Circuit Board Bus Bars", G. Stredde, Jan. 1979, pp. 19–23.

*Primary Examiner*—Neil Abrams

*Attorney, Agent, or Firm*—Anton P. Ness

[57] ABSTRACT

A daughter card insertable into a card cage receives power distributed to terminals mounted along an active side edge. Power bus members comprise insulatively coated rigid copper alloy strips each capable of carrying for example ten amperes of current are terminated to respective terminals spaced along the active edge. The power bus members extend on edge to the interior of a major side surface of the card to terminations with circuit path segments to which electrical components needing to be powered are terminated. At least one similar bus member can comprise a return path extending from at least one ground path segment in the card's interior to a ground terminal along the active edge. Several power bus members can have their insulated body sections grouped together and optionally mechanically joined along substantial lengths thereof to reach the card's interior while remaining electrically discrete.

6 Claims, 8 Drawing Sheets

CIRCUIT PANEL ASSEMBLY WITH ELEVATED POWER BUSES

This application is a continuation of application Ser. No. 07/127,746 filed Dec. 2,1987, now abandoned.

FIELD OF THE INVENTION

The present invention is related to the field of electrical circuit panels, and more particularly to providing power to circuit panels.

BACKGROUND OF THE INVENTION

Card cages are known which comprise a framework within which a plurality of circuit panels or daughter cards are insertable, and within which is disposed a backplane transverse to the back edges of the daughter cards. The cards are electrically connected to the backplane by any of several types of known connectors and terminals, and are interconnected by the backplane to each other and to other electrical components on the opposite side of the backplane. Each daughter card in conventional card cages also receives all necessary power for its components from the backplane through a plurality of terminals. One typical method involves providing a multilayer backplane having power-carrying circuit paths embedded within it, involving significant fabrication expense, to which terminals are engaged to transmit the power current at levels ordinarily about one ampere per terminal through connectors to the daughter card. Connectors which must house the quite numerous power-carrying terminals also must house signal terminals for the primary purpose of providing signal transmission to and from the daughter cards; signal terminals are thus limited in number and in their position, which in turn limits the capabilities of the daughter cards. Also, the current levels presently available limit the number and types of components usable with the daughter cards.

Another feature of conventional card cages is that the power is provided to the backplane from power conductor cables from outside the card cage, and the transmission of power into the card cage is usually controlled by one switch. In such card cages transmission of power to the individual daughter cards is not controlled on a card-by-card basis and in fact power to all the cards is either all ON or all OFF. Therefore, power to all cards must be turned off to permit insertion or removal of an individual daughter card, resulting in undesirable levels of down time.

Multilayering of daughter cards is presently done to transmit power received along the back edge by numerous power terminals, to interior regions of the daughter card in order to avoid interfering with the increasing number and the positioning of signal circuit paths desired, in an effort to enhance the capabilities of daughter cards, given the limitation of back edge power reception in present day card cages. Multilayering of daughter cards, as with multilayering of backplanes, is costly.

It would be desirable to provide power to daughter cards of a card cage individually, and to shut off power individually.

It would be desirable to introduce the power to the daughter cards along edge surfaces other than along the back edge, thus allowing the connectors along the back edge to be devoted to signal transmission and increase the number of signal transmission connections to the backplane.

It would be desirable to provide power at current levels higher than is presently available to individual power paths of the daughter card, and to provide a higher total power current to the card.

It would also be desirable to provide power at current levels of ten amperes or higher, from active or power-receiving edge portions into the interior regions of the card without the necessity of using etched circuit paths or multilayer circuit panel construction.

SUMMARY OF THE INVENTION

The present invention is for use with a system of electrical connectors for distributing power to side edges of daughter cards inserted into a card cage, where the power connectors are mounted to framework of the card cage in opposed pairs Each power connector has a channel, and each daughter card is insertable into the card cage along opposed channels of the opposed connectors. Contact sections along the side edge of the daughter card are portions of power bus paths extending into the interior regions of the side surfaces of the card to electrical components to be powered. Individual terminals in the power connector correspond to the card contact sections and contact ends on cantilever beams thereof are disposed along the channel to be cammed into electrical engagement with the card contact sections by a camming system of the power connector. Other ends of the connector terminals are exposed to be electrically engaged with corresponding terminals of power conductors connected to a power supply within the card cage. The back edge of the daughter card is thus reserved for signal transmission to and from a backplane of the card cage by means of connectors along the back edge and backplane.

The present invention includes assembling a rail member along the active side edge of the daughter card, to follow along the channel of the power connector. The card contact sections are disposed within recesses of the rail in a manner exposing them for engagement by the terminals of the power connector. While the width of the rail is manufactured to correspond to a standardized width of the channels of the power connectors, it includes an edge-receiving groove whose width is manufactured to correspond to the thickness of the daughter card to which it will be secured, which thicknesses vary from card to card according to its source of manufacture. This allows a single size of power connector to accommodate a range of thicknesses of daughter cards in order to standardize the card cage assembly generally independently of the manufacture of the daughter cards.

The present invention also includes rigid power bus members mounted onto the circuit panel and insulated or spaced from the panel surface, extending from the active power-receiving edge to the interior regions where the members are terminated to power circuit path segments. The buses may be joined together in assemblies to conserve accessible surface space on the panel.

It is an objective of the present invention to provide a connector system for distributing power along a side edge of a daughter card instead of via the backplane of the card cage and back edge of the card, and to each daughter card independently of the powering of the other daughter cards in the card cage, and conversely to independently shut off power to the card.

It is yet another objective of the present invention to provide a bus member which can convey power with a current of the range of about ten amperes or more from individual contact sections along the edge of a daughter card to interior regions of the card.

DETAILED DESCRIPTION OF THE PREFERRED EMBODIMENTS

Figure 1:
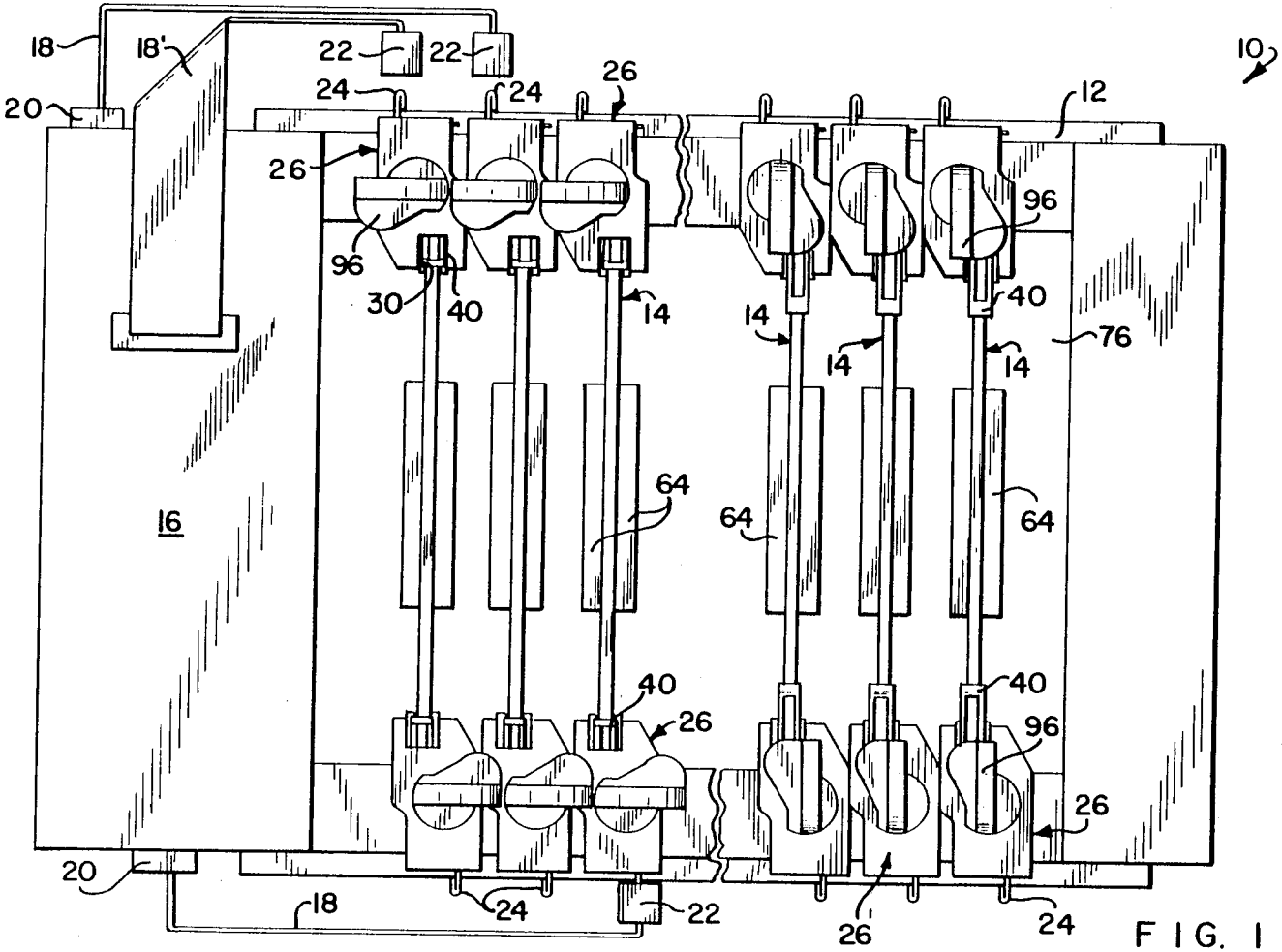
FIG. 1 is an elevation view of a card cage having a plurality of circuit cards therein of the present invention, each disposed between and mated with a pair of edge guide power connectors of the present invention connected to a power source, with the cards on the right being locked in place and the power connectors actuated.

FIG. 1 shows a card cage 10 including a frame 12 having a plurality of representative daughter circuit cards 14 inserted thereinto from the open front, and which may be removed therefrom Cards 14 receive power for electrical components 64 mounted thereon from a power supply 16 also insertable into and removable from the card cage, by means of a plurality of power cables 18. Each cable 18 is electrically connected by first terminal means 20 to corresponding terminal means (not shown) of the power supply, and is terminated by second terminal means 22 for electrical engagement with one or more of a plurality of terminals 24 spaced along an edge guide power connector 26 corresponding to an active edge of a daughter card 14. At least one return path conductor 18' is also provided and connected to the power supply 16. Preferably the plurality of edge guide power connectors 26 are secured to the card cage frame 12 in spaced parallel arrays along the top and bottom of the card-receiving area of the card cage. Such a card cage system is disclosed in more particularity in U.S. patent application Ser. Nos. 07/128,000 and 07/127,992, filed Dec. 2, 1987 and assigned to the assignee hereof. A flexible power distribution system particularly useful with such a card cage system is described in greater particularity in U.S. patent application Ser. No. 07/050,793 filed June 22, 1987 and assigned to the assignee hereof, although conventional power conductor wires may be used.

Figure 2:
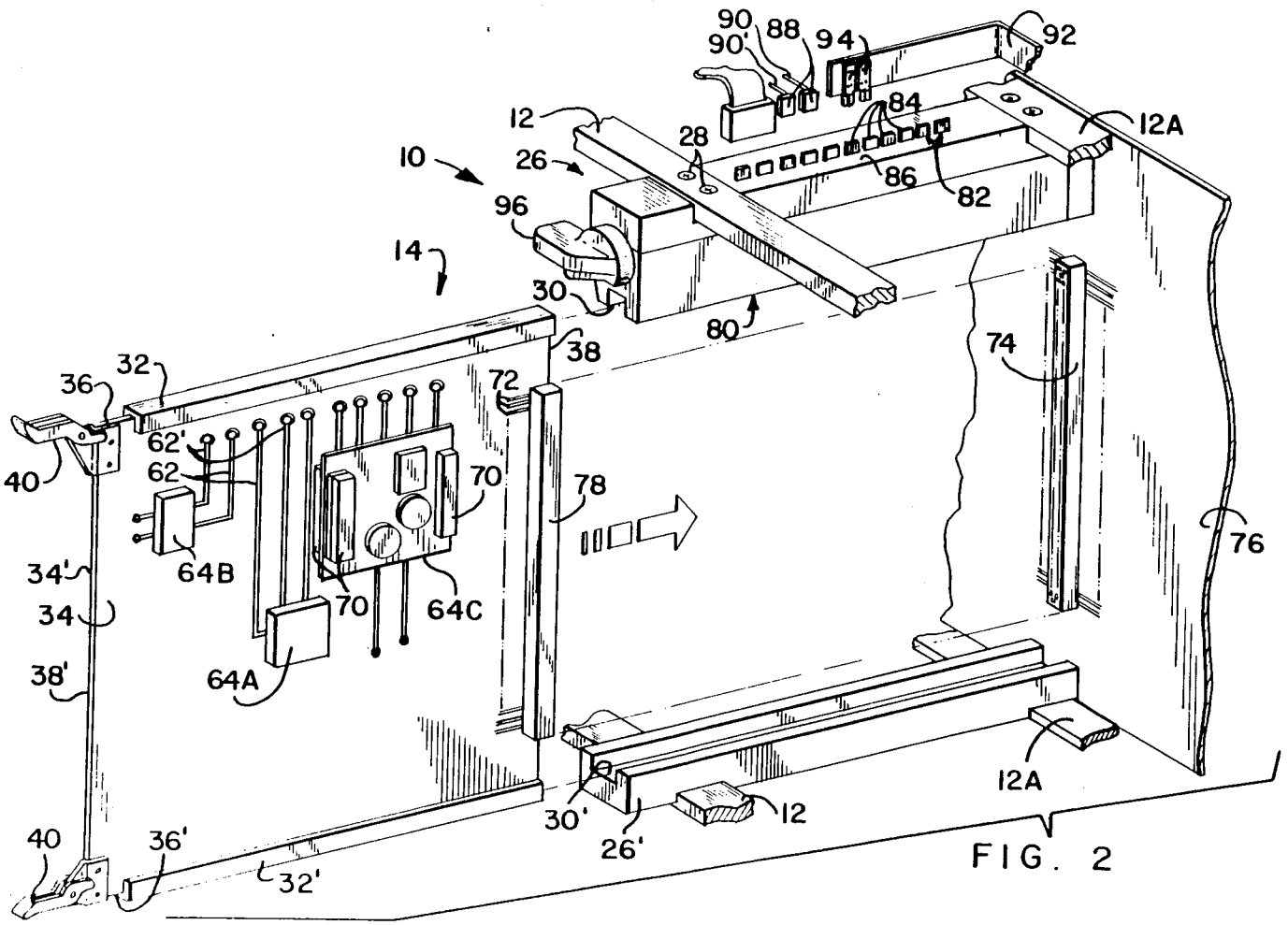
FIG. 2 is a perspective view of a daughter card exploded from its position in the card cage of FIG. 1 and from between an edge guide power connector of the present invention and an opposing channel member.

Referring to FIG. 2, edge guide power connector 26 is mounted to card cage frame 12,12A such as by pairs of fasteners 28 at each end of the connector. Each power connector 26 includes a card-receiving channel 30 within which is disposed a rail 32 secured to an active edge of a daughter circuit card 14. Channel 30 preferably has rectilinear side wall and bottom surfaces, and rail 32 correspondingly preferably has rectilinear top and side surfaces, which surfaces will undergo at least incidental bearing engagement during insertion and withdrawal of card 14 into and out of the card cage. Preferably the front end of channel 30 and the rearward end of rail 32 include tapered corners for lead-in purposes facilitating insertion.

Figure 4:
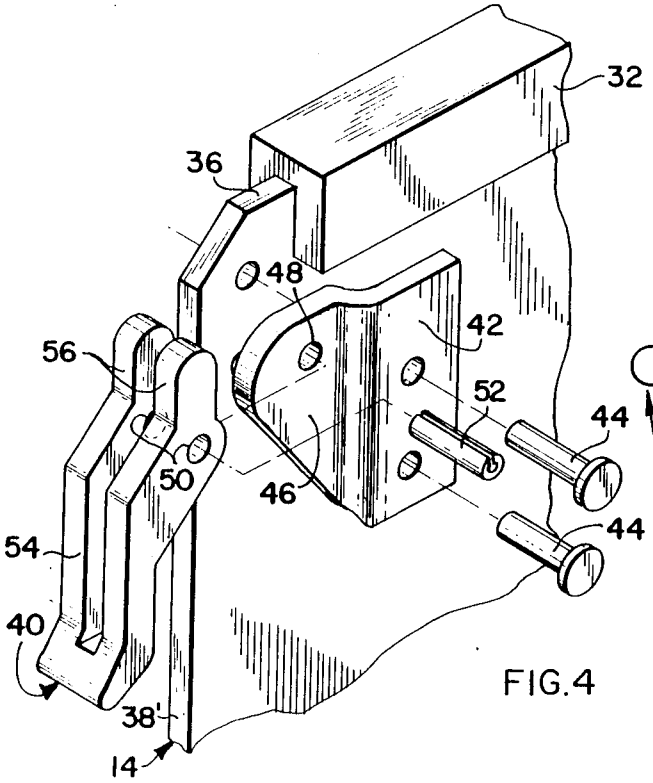
FIG. 4 is an enlarged exploded view of one of the insertion/ejection members of the daughter card of FIG. 3.

Each daughter card has two major side surfaces 34,34', top and bottom edges 36,36', and back and forward edges 38,38'. In a typical card cage 10 top and bottom edges 36,36' of each daughter card 14 may be active edges, and each active edge will have a respective rail 32 so that card 14 can be inserted into the card cage frame from a card-receiving face thereof within aligned and opposing channels 30 of a pair of opposed power connectors 26. However, it is foreseeable that one or more daughter cards 14 may only have one active edge for the receipt of power current and with such a card the edge opposed from the active edge preferably will still have a rail such as rail 32' and be received along a channel 30 of an inactive power connector or dummy member 26' having a card-receiving channel 30', or even a channel of the card cage frame 12 itself Each daughter card 14, once fully inserted into opposed channels 30,30 (or 30,30') therefor, is then secured therein by insertion/ejection members 40 (FIG. 4) which have locking means cooperable with corresponding locking means of the power connectors 26 (or of the dummy connector 26'). Insertion/ejection members which also serve to eject the daughter card partially from the card cage are conventionally known. In FIG. 4 insertion/ejection member 40 is pivotably securable to card 14. Mounting plate 42 is fastened to a corner of card 14 along top edge 36 at front edge 38' using rivets 44, for example. Flange 46 includes a pivot hole 48, and pivot holes 50 of bifurcated insertion/ejection member 40 are aligned therewith on both sides, after which roll pin 52 is inserted through holes 50,48,50. Pin 52 enables pivoting of hand-grippable portion 54 between a secured position as shown and an unsecured position wherein hand-grippable portion 54 extends perpendicularly outwardly from front edge 38'. Locking protrusions 56 will enter a corresponding cavity of power connector 26 in order to secure, after full insertion of card 14 into the card cage.

Figure 3:
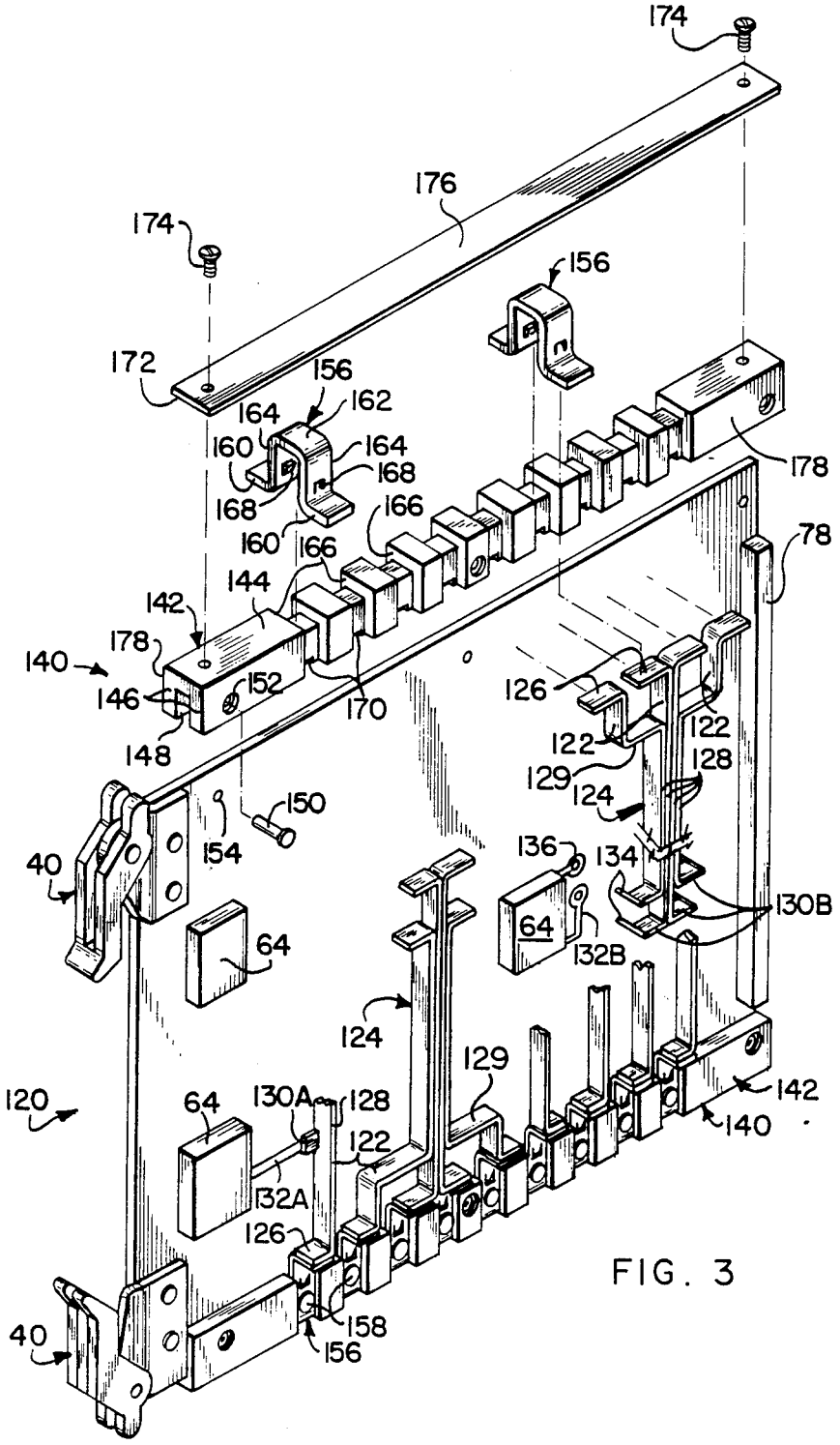
FIG. 3 is a perspective view of the loaded circuit card of the present invention, showing a rail and power buses thereof, with one of the rail assemblies and a representative terminal exploded from an edge of the card and one of the power bus assemblies exploded from a surface of the card.

After card 14 is secured in position an actuator 96 of connector 26 is moved to an actuating position, which cams the plurality of terminals into electrical engagement with corresponding contact means 158 of the daughter card exposed in recesses of the rail shown in FIG. 3. For appropriate electrical engagement to conduct the levels of power current being transmitted to daughter card 14 such as ten amperes or greater at each contact, location for long in-service use, contact means 158 preferably comprise buttons of low resistance silver or silver alloy fastened such as by soldering or by inlaying onto circuit paths 62 which extend to terminals of components 64 to be powered. Corresponding return paths 62' extend back to the active edge of daughter card 14 to be similarly connected to a return path conductor 18'. Alternatively return paths 62' may be commoned to one return path on the daughter card with one contact section along the active edge for electrical connection to one return path conductor via one return terminal of the power connector.

Components 64 can be mounted on either major side surface 34 or 34' of card 14, irrespective of which side surface circuit paths 62 are disposed along, through the use of conductive plated through-holes electrically connected to the circuit paths and of component terminals such as those with pin sections having compliant sections adapted to self-secure within plated through-holes in electrical engagement therewith after being inserted therein, both of which are conventionally known and may be used. It is possible to place power circuit paths 62 on one major side surface such as 34', allowing the other major side surface 34 to be devoted to signal circuit paths such as signal paths 72 along back edge 38.

Components 64 foreseeably usable with circuit panels 14 in a card cage can be, for instance, integrated circuit packages 64A, transistors, solid state components, and also LEDs such as LED 64B placed near front edge 38' for visual indication of a POWER ON state of the daughter card. As is disclosed in Ser. No. 07/128,000, smaller circuit cards or baby boards 64C can be in turn mounted onto the daughter card and have components to be powered by the card, with electrical engagement established using, for example, stacking connectors 70 such as AMP HDI connectors sold by AMP Incorporated, Harrisburg, Pa.

Upon actuation of edge guide power connector 26, daughter card 14 and its components 64 will be powered. With power current being brought to the card from the top edge 36 or both the top and bottom edges 36,36', back edge 38 of the card with its premium real estate can be devoted to the electrical connection of signal paths 72 of the card to corresponding contact means of connectors 74 mounted on backplane 76 of card cage 10, upon full insertion of card 14 in the card cage. Backplane 76 is also a circuit panel as are daughter cards 14 and is secured to the framework of the card cage to be orthogonally disposed adjacent and transverse with respect to back edges 38 of all the daughter cards 14 inserted into the card cage. Connectors 74 mounted on backplane 76 have terminals electrically connected to respective circuit paths of the backplane which interconnect corresponding contacts of connectors 78 such as AMP HDI connectors, of the various daughter cards mounted on back edges 38 thereof As can be seen in FIG. 2, a rearward frame portion 12A can abut backplane 76 to precisely locate the edge guide power connector 26 such that the mating pair of signal connectors 78,74 have just enough clearance to mate properly when card 14 is locked in position. Frame 12A can also assure that rearward end of the power connector 26 is aligned with respect to connector 74 that its card-receiving channel brings back edge 38 of card 14 and connector 78 into precise alignment with connector 74 upon insertion.

Backplane 76 can also have pin or post arrays (not shown) to permit conventional wire wrapping to achieve electrical interconnection. Backplane 76 can also provide for electrical connection of terminals of connectors 78 with corresponding contact means of components or other circuit boards (not shown) mounted in card cage 10 behind backplane 76, such as is conventionally known. With the backplane freed of the duty of transmitting power to the daughter cards as has been conventional, and providing for signal transmission to and from the daughter cards for communication therebetween, much greater card cage utility is provided than has been known prior to the present invention.

Also shown in FIG. 2 edge guide power connector 26 comprises a dielectric housing assembly 80 including channel 30 into which rail 32 along an active edge of the daughter card will be inserted. Housing assembly 80 also includes a plurality of terminals 82 firmly mounted therewithin along the top portion and having a first contact section 84 for electrical connection to a terminal means of a power cable means connected to power supply 16. Preferably first contact section 84 is blade-like and extends from top surface or cable face 86 of housing assembly 80 to be engaged by a corresponding receptacle terminal secured to a power conductor electrically connected to power supply 16, as shown in FIG. 1.

Each edge guide power connector 26 has an actuator 96 which is actuatable to power the associated daughter card independently of the other daughter cards in the card cage, and as such represents a singular major advance in card cages. Also each power connector 26 can be independently deactuated to permit removal of its daughter card for repair or replacement, while all other cards remain fully powered and functioning.

Terminals 88 connected to conventional power and return conductors 90,90' can be for instance the fully insulated receptacle type sold under the trade designation Ultra-Fast FASTON by AMP Incorporated, Harrisburg, Pa. A preferred power conductor is a flexible flat power cable 92, such as the cable disclosed in U.S. patent application Ser. No. 07/050,793, using for example terminals 94 which are terminatable to flat conductor cable in a manner similar to that utilized by terminals sold under the trademark TERMI-FOIL by AMP Incorporated, and using an appropriate blade-matable receptacle structure similar to the FASTON terminals. The power conductor terminals may preferably be removable from first contact sections 84 enabling repair or replacement of a terminal or of the power cable. Each terminal 82 of the edge guide power connector further includes a cantilever portion extending therefrom to a free end on which is disposed a second contact section (not shown) which is cammed into electrical engagement with a contact means 158 of the daughter card by a camming means extending through housing assembly 80, upon actuation thereof by rotary movement of actuator 96.

The daughter card of the present invention is shown in FIG. 3. In assembly 120 power may be transmitted from each active edge to a component 64 by means of power bus members 122 which are preferably grouped into power bus assemblies 124 to preserve surface area of the circuit panel for mounting of components. The bus members 122 may be joined to each other to form assembly 124 such as by using MYLAR tape, a product of E. I. DuPont de Nemours, and Co., which tape is coated on both sides by a heat sensitive adhesive which is cured. Each power bus member 122 includes a first termination section 126 at the active edge, a body section 128, and a second termination section 130A,130B in the interior of the major side surface 34,34' of the daughter card to be electrically connected to a power circuit path segment 132A,132B respectively of the daughter card to which the component is also electrically connected.

The second termination section of each power bus member 122 may be either a second termination section 130A which is surface mounted to a circuit path segment 132A of the daughter card such as by soldering or a second contact section 130B including a pin section 134 joined to power bus 122 and inserted into and soldered within a plated through-hole 136 of a power circuit path 132B. Each power bus member 122 may be coated with an insulative covering except at the termination sections such as with insulative varnish, and preferably are rigid bars of for example 0.02 inches thick and 0.25 inches high of an appropriate conductive alloy such as ASTM B-152 high copper content alloy. Such bus members have a conductive mass substantial enough to carry currents of levels of ten amperes or higher as desired, significantly higher than that carried by conventional etched circuit paths of circuit panels.

Most preferably each bus member 122 has at least two portions, as shown in FIG. 3, extending generally at an angle and preferably perpendicularly to their longitudinally extending body sections 128, for stability when disposed on edge on the daughter card. To conserve the amount of surface area on the side surface of the circuit panel, power bus members 122 are preferably mounted along the card's surface on edge, with the widths thereof extending a distance outwardly from the surface instead of along the surface. Power bus members are preferably elevated above the surface of the circuit panel by their termination sections, and they may also be insulated. As a result they may pass over signal paths on the surface of the daughter card until they reach their intended termination point in the interior of the card, greatly enhancing the utilization of the card's valuable real estate for signal transmission, without resort to the use of multilayer daughter cards and the costly fabrication process involved therewith, just to provide for bussing of power from spaced power-receiving locations along the active the edge to the interior without interfering with signal circuit paths. Where the grouped portions of body sections 128 of an assembly 124 are not aligned with a particular power-receiving location along the active edge, an angled portion 129 extends from a body section 128 of the corresponding bus member 122 to a position aligned with the particular power-receiving location, and the bus member continues to a first termination section 126 at the location.

Along each active edge of the daughter card in FIG. 3 is a connector rail assembly 140 comprising a profiled dielectric rail member 142 having a body section 144 inwardly from which extend a pair of opposed pair of flanges 146 defining a card-receiving groove 148 therebetween. Rail 142 is mounted on the active edge of the card with the top (or bottom) side edge of the daughter card secured in card-receiving groove 148, such as by the use of rivets 150 extending through aligned countersunk holes 152 of the flanges 146 and holes 154 of the daughter card. A plurality of terminals 156 are contained in rail assembly 140, and each terminal 156 includes a contact section 158 to be electrically engageable by a corresponding contact means of the edge guide power connector, and termination sections 160 electrically connected to first termination sections 126 of two respective power bus member 122 (one on each side of card 120), such as by soldering or welding, or optionally by using spring clips (not shown) of stainless steel which can be removed if desired for servicing and repair of the daughter card.

Each terminal 156 has a top horizontal section 162 and two vertical sections !64 depending therefrom and disposed within recesses 166 of rail member 142. Terminal 156 may be mounted to rail 142 such as by using locking lances 168 on vertical sections 164, which lock behind stop surfaces 170 of rail 142. Then a dielectric cover member !72 is preferably secured along the top surface of rail member 142, fastened thereto by a plurality of screws 174 spaced periodically therealong, with cover member 172 covering horizontal sections 162 of terminals 156. Power bus members 122 can be securable to the daughter card by the joints with terminals 156 of the connector rail and by pin sections 134 soldered in plated through-holes 136 of power circuit paths 132B. Power bus assemblies 124 can be joined together such as by bonding the body sections of individual bus members 122 such as with the doubled-sided MYLAR tape as explained above.

Figure 5:
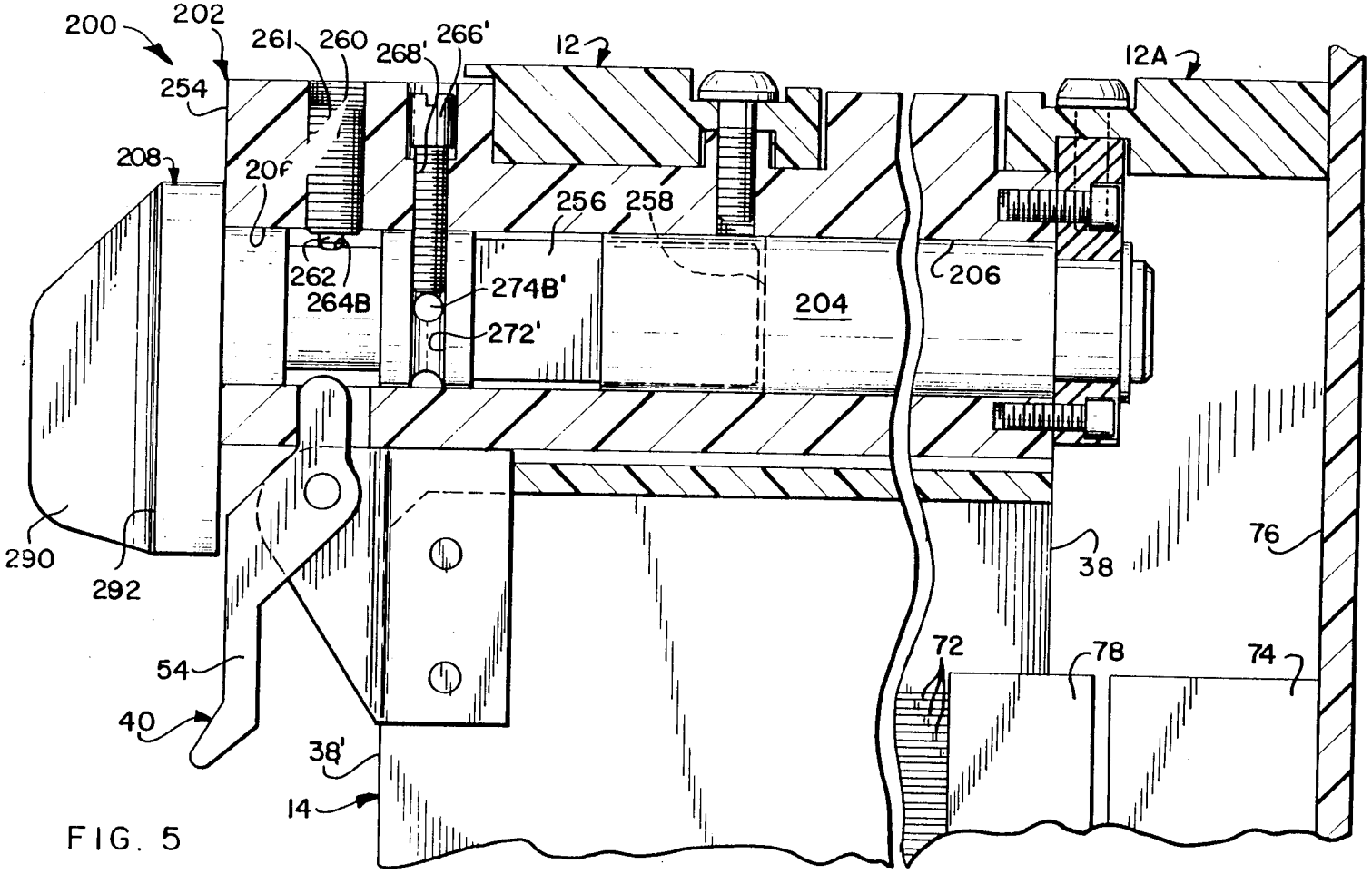
FIGS. 5 and 6 are part longitudinal section views of a daughter card in the edge guide power connector showing the insertion/ejection of the card and a cam actuator of the power connector.
Figure 6:
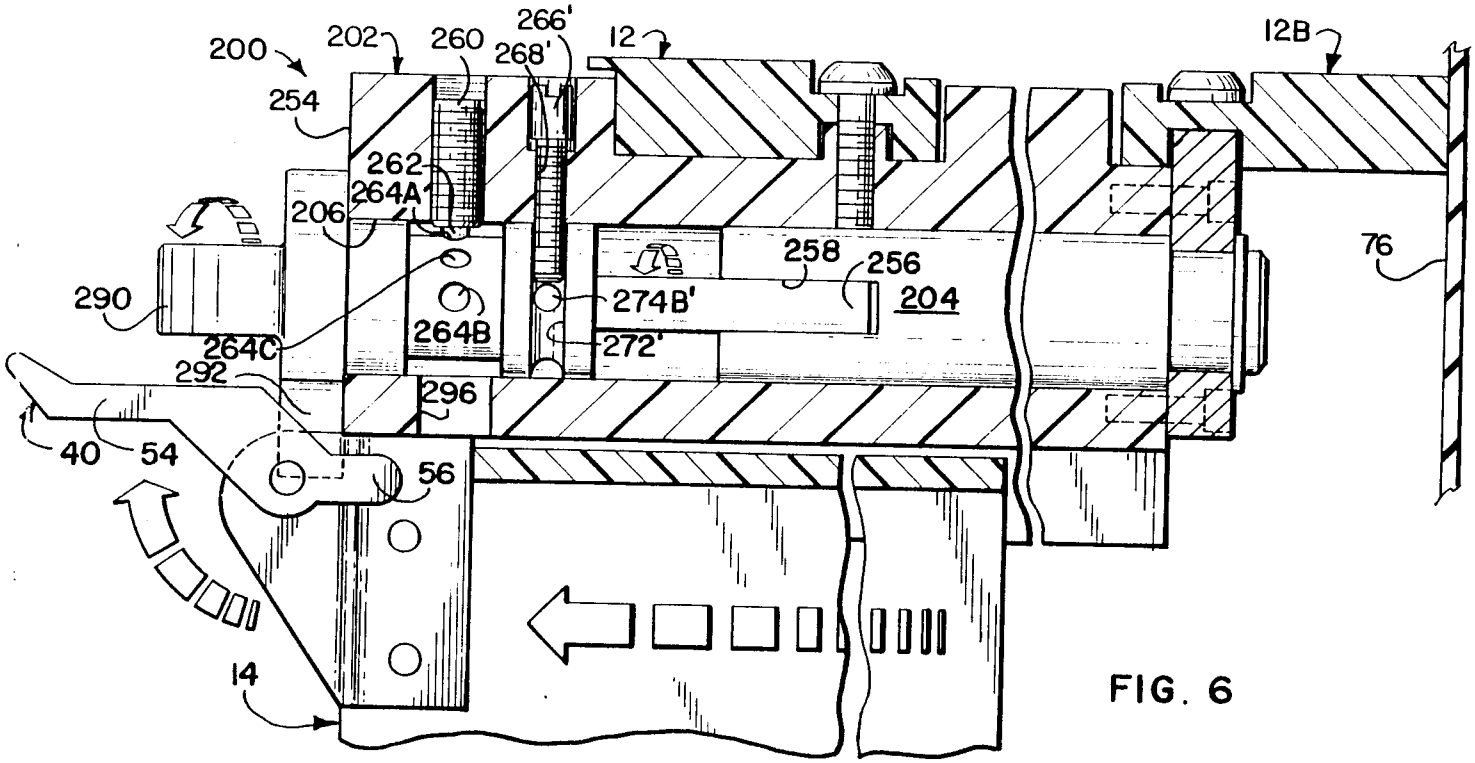
Figure 7:
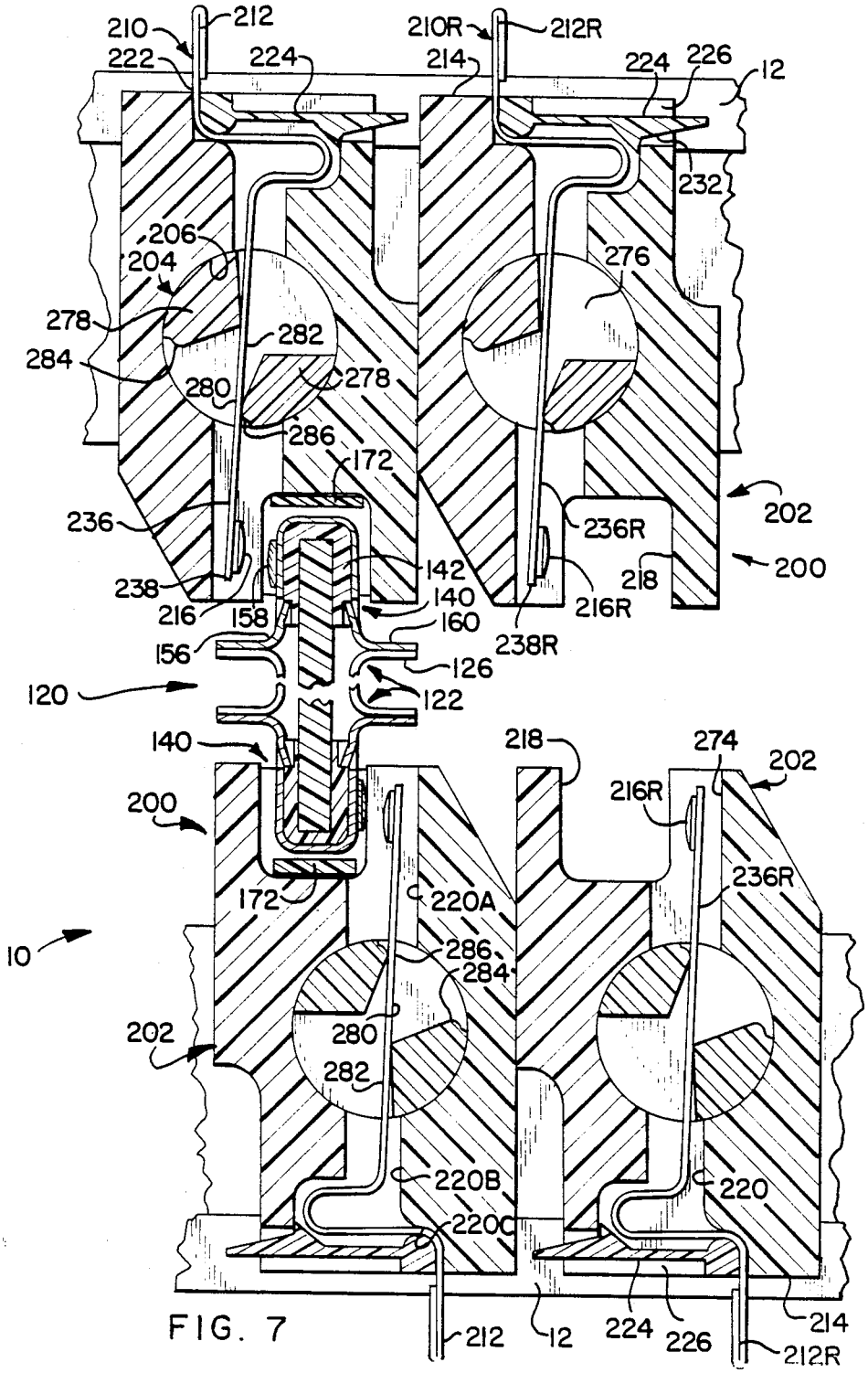
FIG. 7 is an enlarged cross-sectional view of the daughter card of FIG. 3 disposed in the guide channels of a pair of power connectors to be mated, and an adjacent pair of empty power connectors therebeside showing return terminals therein.

In the first embodiment 200 of edge guide power connector shown in FIGS. 5 to 7, the housing, the camming means, and the terminals are all adapted for rotary camming movement, as disclosed in U.S. patent application Ser. No. 07/127,747 filed Dec. 2, 1987 and assigned to the assignee hereof. Power connector assembly 200 includes a dielectric housing 202 and a cylindrical cam shaft 204 extending through and secured in a corresponding cylindrical cam-receiving aperture 206 extending along housing 202. Secured onto the forward end of cam shaft 204 is actuator member 208 which is rotatable from an unactuated position to an actuated position to rotate cam shaft 204. A plurality of terminals 210 (FIG. 7) are secured in housing 202 to transmit power current from the power conductors to the active edge of the daughter card in a distributed manner. First contact sections 212 of terminals 210 are exposed along cable face 214 for electrical connection with contact means of the power conductor means, and can comprise blade sections extending upwardly to receive therearound appropriate receptacle contact sections of the power conductors. Second contact sections 216,216R of terminals 210,210R are disposed along card-receiving channel 218 for engagement with contact means 158 of daughter card 14 upon actuation of edge guide power connector 200. Terminals 210,210R preferably are disposed in a single row, with second contact sections 216,216R thereof also disposed in a single row along one side of card-receiving channel 218 preferably to engage contact means 158 of daughter card 14 along a common side of the active edge of the card.

Referring to FIG. 7, terminals 210,210R are securable in respective terminal-receiving passageways 220 which have first portions 220A in communication with card-receiving channel 218 and second portions 220B which are in communication with cam-receiving aperture 206. Terminals 210,210R include mounting portions 222 along the cable face 214 of connector 200 and secured in third passageway portions 220C such as by mounting members 224 received into mounting member recesses 22 of housing 202 which are profiled to provide opposed channels to receive flanges of members 224 therealong. Cantilever portions 236,236R depend from mounting portions 222 and conclude in free ends 238,238R, on which are disposed second contact sections 216,216R.

Spring loaded detent assembly 260 is threadedly secured in hole 261 so that detent 262 can be received into a first cavity 264A defining a first or unactuated position placed at one angular position about actuator member 208, a second cavity 264B defining a second or actuated position spaced angularly preferably 90 degrees from first cavity 264A, and a third cavity 264C midway therebetween may define a cam shaft position enabling assembly of terminals 210 into power connector 200.

Actuator member 208 is shown in FIGS. 5 and 6 secured in aperture 206 by a pair of set screws 266' threaded into laterally offset holes in housing 202, each with a shank disposed alongside actuator member 208 in an annular recess 272'. Projections 274A',274B' can be used with set screws 166' to provide stops preventing over-rotation of cam actuator 208.

Projection 256 of actuator member 208 rotates cam shaft 204 when actuator 208 is itself rotated. Cantilever portions 236,236R are inserted through respective profiled apertures 276 of cam shaft 204 so that free ends 238,238R and second contact sections 216,216R thereon extend past the other side of cam shaft 204 through passageway portions 220A and along recesses 274 aligned with apertures 276 and spaced along card-receiving channel 218, as seen in FIG. 7.

As shown in FIG. 7, each profiled aperture 276 is preferably defined by opposed transverse side surfaces and generally inwardly facing surfaces of opposed triangular lands 278 having respective apices proximate to but spaced from each other near the center of cam shaft 204. Cantilever portion 236 of respective terminal 210 has an outwardly facing side 280 and an inwardly facing side 282. A first cam surface 284 faces and engages outwardly facing side 280 at least upon cam actuation to deflect cantilever portion 236 inwardly to move terminal free end 238 into card-receiving channel 218 for second contact section 216 disposed thereon into engagement with a corresponding contact section 158 of the daughter card. A second cam surface 286 faces inwardly facing side 282 of cantilever portion 236 and is engageable therewith when cam shaft 204 is moved to the unactuated orientation to deflect and hold cantilever portion 236 outwardly to remove free end 238 from channel 218, disengaging the contact sections and permitting withdrawal of the daughter card from channel 218.

The use of first and second cam surfaces 284,286 provides positive deflection of cantilever portion 236 for controlled continuously applied force on terminal 210 and results in assured contact engagement of second contact section 216 with the corresponding contact means of the daughter card when actuated, and assured clearance from channel 218 when unactuated. Terminals 210 preferably are aligned in a single row such that cantilever portions 236 thereof may be deflected in a common direction toward a coplanar array of contact means along a common side of the active edge of the daughter card, upon actuation by first cam surfaces 284, with second contact sections 216 facing card-receiving channel 218. While it may be preferred to cam the cantilever beams of power terminals 210 simultaneously into and out from electrical engagement with the daughter card contact sections 158, it is sometimes preferable to cam the cantilever portion of return terminals 210R before the others, and disengage return terminals 210R last, or to power a selected component first and disconnect it last, utilizing a terminal similar to terminal 210R. Contact section 216R of terminal 210R is raised or higher than contact sections 216 of the other terminals, thus physically engaging its corresponding contact section of daughter card 14 first upon actuation, and disengaging last upon deactuation.

Figure 9:
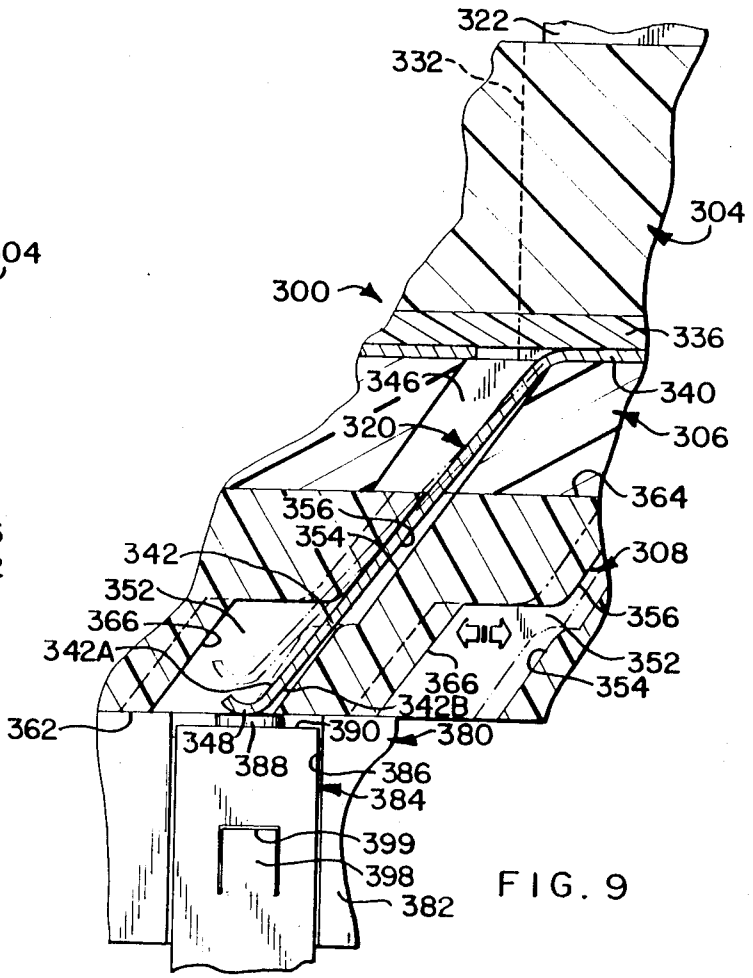
FIG. 9 is an enlarged longitudinal section view showing a terminal of the power connector of FIG. 8 cammed in an actuated position, and in a deactuated position (in phantom).
Figure 8:
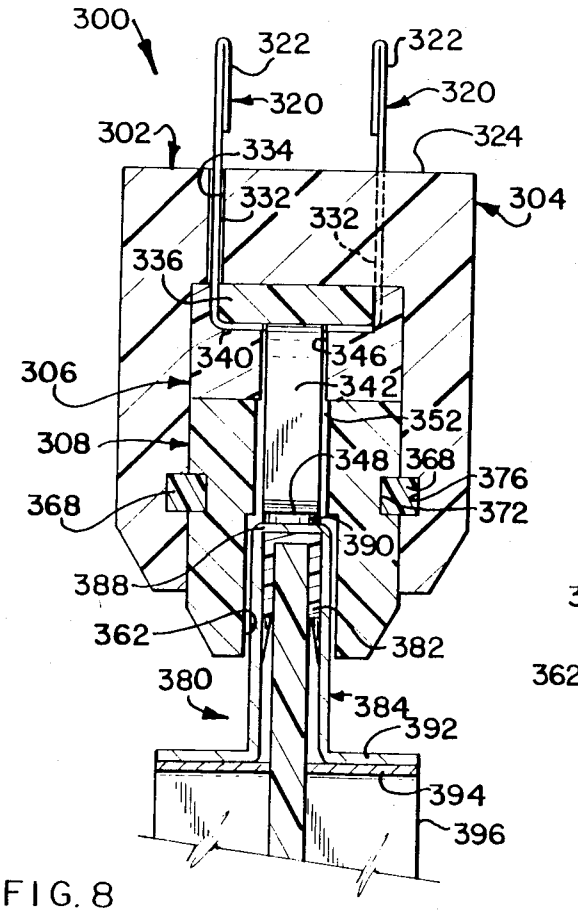
FIG. 8 is a cross-sectional view of a daughter card of a second embodiment in the channel of a linear cammed power connector and a terminal engaged with a card contact section.

FIGS. 8 and 9 illustrate a second embodiment 300 of edge guide power connector, one having a linear motion cam shaft, as disclosed in U.S. Pat. No. 4,789,352, and a corresponding active edge of a daughter card. Connector 300 includes a housing assembly 302 including a first or upper housing member 304, a second or middle housing member 306, cam shaft or member 308 comprising the bottom portion of housing assembly 302 and having a rotary actuator at its forward end similar to actuator 208 of FIG. 5, and forward and rearward housing members (not shown). Connector 300 also includes a plurality of terminals 320 having respective first contact sections 322 extending upwardly from cable face 324 to be engageable by corresponding terminal means of power and return conductor means (FIG. 1) of the card cage. Upper housing member 304 includes a pair of depending flanges 326 having inwardly facing surfaces 328 forming cam-receiving channel 330, within which are disposed middle housing member 306 and cam shaft 308 upon assembly. Terminals 320 may have their first contact sections 322 disposed in two rows along cable face 324, if desired.

Referring to FIG. 9, vertical mounting section 332 of each terminal 320 extends through a vertical passageway 334 of upper housing member 304. An insert member 336 is disposed between lower surface 338 of upper housing member 304 and horizontal body section 340 of terminal 320, and middle housing member 306 holds horizontal body section 340 against insert 336. Spring arm 342 of terminal 320 extends downwardly from forward side edge 344 of horizontal body section 340 and forwardly at an angle through an angled opening 346 of middle housing member 306. Spring arm 342 extends to a free end 348 below lower surface 350 of middle housing member 306 into and through a corresponding angled opening 352 of cam shaft 308 defined by forwardly facing surface 354, rearwardly facing surface 356 and side surfaces. Cam shaft 308 has a body section 358 downwardly from both sides of which depend opposing spaced flanges 360 defining card-receiving channel 362. Each angled opening 352 extends from upper surface 364 of cam shaft 308 to channel 362 to be in communication therewith so that free end 348 can be deflected into channel 362 to engage a contact section of a corresponding terminal of the daughter card disposed along channel 362. Each angled opening 352 includes a recessed portion 366 in which arcuate-shaped free end 348 is disposed when not deflected into channel 362.

A pair of retention rails 368 provide a means for cam shaft 308 to be moved linearly with respect to the remainder of housing assembly 302, along lower surface 370 of middle housing member 306. Rails 368 are received along channels 372 on outer side wall surfaces 374 of body section 358 of cam shaft 308 paired with and facing opposed channels 376 along inwardly facing surfaces 328 of flanges 326 depending from upper housing member 304. The rail ends are held in the passageways of forward and rearward housing members.

Shown in FIGS. 8 and 9 is an embodiment 380 of a daughter card appropriate for use with connector 300. Its active edge includes a dielectric rail 382 secured thereto by periodically placed rivets (not shown) and including a plurality of terminal members 384 mounted in shallow recesses 386 therealong. Each terminal member can extend recessed along one or both side surfaces of rail 382 and recessed across the top surface, and includes a contact section 388 preferably a button of silver or silver alloy soldered along the terminal's top surface 390 to be engaged by arcuate-shaped free end 348 of terminal 320 of power connector 300 when actuated. Terminal 384 has at least one termination section 392 soldered or welded or clipped to a corresponding termination section 394 of a power bus member 396 of the card. Mounting of terminal 394 can be by a pair of locking lances engaging stop surfaces on both sides of rail 422.

Referring to FIG. 9, when cam shaft 308 is moved rearwardly during actuation, rearwardly facing surface 356 of angled opening 352 of cam shaft 308 engages the front side 342A of spring arm 342 of terminal 320 and deflects it downwardly and rearwardly so that free end 348 is rotated into channel 362. Surface 356 holds free end 348 under tension against contact section 386 of daughter card 380 to establish a desired continuous contact normal force, which action incidentally creates a wiping action along the contact surfaces to break up oxides which typically form. When cam shaft 308 is moved to an unactuated position, forwardly facing surface 354 engages back side 342B of spring arm 342 and urges it forwardly and upwardly into recess 366 where it continuously holds it away from daughter card terminal 384 and clear of channel 362.

Figure 10:
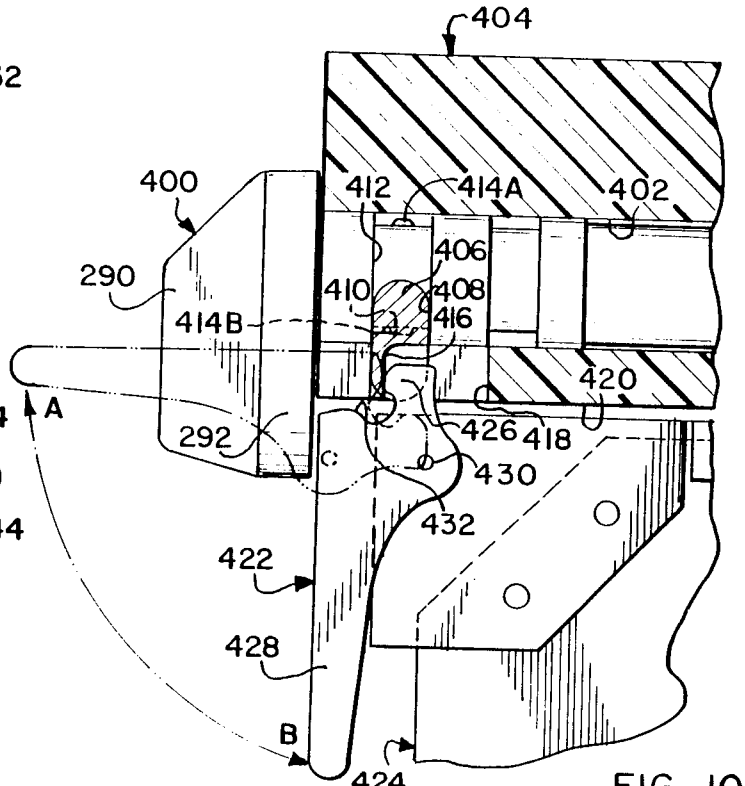
FIG. 10 is a part longitudinal section view showing another insertion/ejection member in the secured position, with the unsecured position shown in phantom.

As shown in FIG. 10, actuator member 400 may be secured in aperture 402 of housing member 404 by a key member 406 force-fitted into slot 408 of housing member 404 in communication with aperture 402. Corner 410 of key member 406 is inversely radiussed to fit within a corresponding annular recess 412 of actuator member 400 upon assembly, which restrains the actuator from axial movement along aperture 402, keeping it secured in the housing. Projections 414A,414B within annular recess 412 are positioned to abut sides of key member 406 when actuator member 400 has been rotated to either an unactuated position or an actuated position to prevent over-rotation.

Referring to FIG. 10, a plate portion 416 of key member 406 depends relatively from key member into a cavity 418 of housing member 404. Cavity 487 extends upwardly from the bottom surface of card-receiving channel 420 to communicate with slot 408 within which key member 406 is disposed. Plate portion 416 is positioned to be engaged by insertion/ejection member 422 after insertion of daughter card 424 into channel 420 in order to enable member 422 to secure card 424 in the card cage, and to enable member 422 to be manipulated to eject card 424 from the card cage for removal. Projection 426 of member 422 engages behind plate portion 416; as lever portion 428 is continued to be rotated downwardly about pivot 430 from position A to position B, projection 426 is relatively pushed rearwardly by plate portion 416 to urge card 424 completely into its fully inserted position. When it is desired to withdraw card 424 from the card cage, member 422 is rotated upwardly and anvil portion 432 engages the front surface of plate portion 416 and is pushed relatively forwardly to move card 424 slightly forwardly in ejection allowing card 424 then to be pulled completely out of the card cage. This insertion and ejection action serves to facilitate the mating and unmating of connectors 78 along the back edge 38 of the card with connectors 74 mounted on the backplane 76 as shown in FIGS. 2 and 6. Such an insertion/ejection member 422 is sold by Calmark, Inc.

Now referring to FIG. 3, rail assembly 140 preferably has rectilinear outwardly facing top 176 and side 178 surfaces suitable to be bearing surfaces for insertion into the correspondingly shaped channel of the edge guide power connector. Being recessed below top surface 176 and side surfaces 178, terminals 156 do not interfere with insertion of daughter card assembly 120 into channels of the power connectors. Rails 142 and 32 both provide substantial resistance to the tendency of daughter cards to warp over the substantial length of their side edges 36,36'. Terminals 156 may be formed of ASTM B-152 copper alloy, for example, with contact sections 158 preferably being buttons of silver or silver alloy soldered onto vertical sections 164. Rail and mounting members 142,172 may be molded of glass-filled thermoplastic polyester resin. The insertion/ejection members may be the same as those shown in FIG. 4, or may be like those of FIG. 10, both of which operate in similar manners during insertion and ejection.

Close control over contact engagement and the application of contact normal force can be maintained, given the coupling of the edge guide power connector and the daughter card's active edge, by careful assembly of the power connector and by fabrication of the rail member so that contact surfaces of the contact sections along the side or top of the circuit panel are maintained a selected incremental distance from the level of the outer side or top surface of the rail. For contact sections along the side of the active edge, this can be accomplished by standardizing the thickness of the rail's flange along the contact section side, allowing the opposite flange to be varied in thickness according to the thickness of the particular circuit panel substrate with which the rail is to be used, which still maintains a standardized overall width to the rail member so that power connectors and their channels can be manufactured with common dimensions and still accommodate a variety of circuit panels.

In order to assure that power is not transmitted to the active edge of the daughter card prior to the card being locked in position, it is preferred that a physical interference occur between insertion/ejection member 40 of the daughter card and the actuator of the power connector which prevents moving the actuator into its actuating position unless the insertion/ejection member is in its locked position. Referring to FIGS. 5 and 6, actuator 208 includes a hand-grippable portion 290 and a transverse portion 292. Actuator 208 is in the unactuated position with hand-grippable portion 290 disposed horizontally and extending toward the left of its connector 200. The actuated position is shown where the hand-grippable portion would be vertical or downward. Hand-grippable lever portion 54 of insertion/ejection member 40 in FIG. 7 is in the unlocked or open state and extends out forwardly of the daughter card.

In order for actuator 208 to be rotated 90 degrees for actuation, transverse portion 292 would have to be moved in a path intersecting the position of lever portion 54 of insertion/ejection member 40 in its open state. In its closed or secured position, lever portion 54 is vertical along the front edge of daughter card 120 (FIG.

5), which provides clearance for the transverse portion so that actuator 208 can be moved to its actuated position. Locking protrusions 56 are shown in locking position within locking aperture 294 of power connector 200 (FIG. 5).

The interference system also requires that actuator 208 be positioned in its unactuated position in order for the daughter card to be either inserted into or withdrawn from the channel of the power connector, thus assuring that the cantilever portions of all the terminals of the power connector are clear of the channel and their free ends disposed in the respective recesses. When actuator 208 is in its actuated position, transverse portion 282 is disposed in front of rail assembly 140 of the daughter card and blocks insertion/ejection lever portion 54 from being rotated upwardly to unlock and eject the daughter card from the card cage.

Variations may be made to the embodiment of the present invention described herein without departing from the spirit of the invention or the scope of the claims.

What is claimed is:

1. A circuit panel having a plurality of electrical components mounted thereon at respective locations and requiring electrical power, comprising:

a rigid dielectric substrate having opposed major side surfaces having circuit path means thereon for signal transmission, at least one of said major side surfaces having a plurality of electrical components mounted thereon at respective locations, said substrate having at least one edge portion selected to be an active edge for receipt of electrical power at a plurality of power-receiving locations spaced therealong each having a respective terminal means; and at least one bus assembly mounted to and along a respective said substrate side surface and including a plurality of power buses and at least one return bus adapted to conduct electrical power therealong from said active edge to said electrical components, each said power and return bus comprises a rigid metal bus member of substantial conductive mass and including an elongate body section of selected thickness and having opposed parallel major side surfaces of substantially constant width and opposed parallel side edge surfaces, said body section extending between a first termination section and a second termination section;

each said first termination section joined to a corresponding terminal means of a respective one of said power-receiving locations along said active edge for electrical engagement with respective power or return path conductor means, and each said second termination section adapted to be ultimately electrically connected to a said electrical component, and each said body section being insulated from other circuit path means of the substrate;

said bus assembly being secured to said substrate side surface such that each said bus member is disposed on edge with respect to said substrate, and substantial lengths of said body sections extend to interior regions of said circuit panel and are grouped together adjacent and substantially against each other, said substantial lengths being separated by insulative material, and angled portions extend from said body sections proximate said active edge and along said substrate surface on edge to conclude in respective said first termination sections joined to respective said terminal means spaced along said active edge, whereby the substantial lengths of the body sections of the several bus members essentially extend to interior panel regions along one path and power is supplied thereto in a manner maximizing the surface area available for signal transmission circuit paths and mounting of electrical components.

2. A circuit panel as set forth in claim 1 wherein said bus members of said bus assembly are secured together along said substantial lengths of body sections portions.

3. A circuit panel as set forth in claim 1 wherein said first termination sections of said power buses and corresponding termination sections of said terminal means are tab portions disposed on edge with respect to said substrate and have facing major surfaces joined to each other.

4. A circuit panel as set forth in claim 3 wherein said terminal means spaced along said active edge are respective terminal members secured to said substrate.

5. A circuit panel as set forth in claim 1 wherein a said second termination section is a pin section extending from a said bus member to be insertable into and solderable within a socket contact means of said substrate in electrically conductive engagement with a circuit path segment extending to a contact means of a respective said electrical component.

6. A circuit panel as set forth in claim 1 wherein said second termination section comprises a tab portion extending from a said side edge of a said bus member parallel and adjacent and soldered to a circuit path segment of said substrate extending to a contact means of a respective said electrical component.

* * * * *

UNITED STATES PATENT OFFICE

CERTIFICATE OF CORRECTION

Patent No. 4,869,673 Dated September 26, 1989

Inventor(s) Earl R. Kreinberg and Roger N. Polk

It is certified that error appears in the above-identified patent and that said Letters Patent is hereby corrected as shown below:

In the Claims:

Column 14, line 28, Claim 2, the word "sections" should be "section".

Column 14, line 45, Claim 6, Add the word --a-- after the word "wherein".

Signed and Sealed this

Seventh Day of August, 1990

*Attest:*

HARRY F. MANBECK, JR.

*Attesting Officer*

*Commissioner of Patents and Trademarks*